US007621241B2

(12) United States Patent
Gecim

(10) Patent No.: US 7,621,241 B2
(45) Date of Patent: Nov. 24, 2009

(54) HYDRAULIC-PRESSURE ACTUATED LOCKING MECHANISM AND METHOD

(75) Inventor: Burak A. Gecim, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 366 days.

(21) Appl. No.: 11/626,025

(22) Filed: Jan. 23, 2007

(65) Prior Publication Data

US 2008/0173268 A1 Jul. 24, 2008

(51) Int. Cl.
*F01L 1/34* (2006.01)

(52) U.S. Cl. ..... 123/90.16; 123/90.15

(58) Field of Classification Search ..... 123/90.15, 123/90.16, 90.17, 90.31
See application file for complete search history.

(56) References Cited

U.S. PATENT DOCUMENTS 3,679,317 A 7/1972 Larson
6,076,491 A * 6/2000 Allen ..... 123/90.16
7,328,675 B2 * 2/2008 Seitz et al. ..... 123/90.39

FOREIGN PATENT DOCUMENTS

WO WO2004083608 A1 9/2004
WO WO2004094791 A1 11/2004
WO WO2005005787 A1 1/2005

* cited by examiner

*Primary Examiner*—Zelalem Eshete

(57) ABSTRACT

A mechanism and method is provided for preventing instantaneous unlatching of a driving and a driven member upon an accidental drop in the hydraulic-holding pressure. One embodiment of the mechanism includes a housing having an inlet port connectable to a substantially sustained high pressure fluid source; and a configured locking pin axially displaceable to an engaged position with respect to the inlet port in response to high pressure fluid entrapped in the housing. The locking pin is spring-biasingly axially displaceable to a disengaged position when the pressure is low. The axial displacement of the locking pin sufficiently overlaps the inlet port to form a variable orifice so that the rate of exhausting of entrapped fluid is variable. In another embodiment, the entrapped fluid is slowly exhausted until a seal length is reduced to zero by the retraction of the locking pin. In another embodiment, latching and unlatching is controlled by pressure pulses. In the latched state, contact between positively-engaged parts negates the need for sustained high fluid pressures.

11 Claims, 3 Drawing Sheets

HYDRAULIC-PRESSURE ACTUATED LOCKING MECHANISM AND METHOD

TECHNICAL FIELD

The invention relates to a hydraulic-pressure actuated latching mechanism operable between a driving and a driven member.

BACKGROUND OF THE INVENTION

To impart motion of a driving member to a driven member, the driving and driven members have to be latched and held without relative rotational motion between them. For example, in a cam-and-follower arrangement, cam motion is imparted to a valve-actuating rocker arm by a cam follower. Here the driving member is the cam follower and the driven member is the rocker arm. The rocker arm is pivoted to ground at one end and actuates a valve against a valve spring at its opposite end. A locking pin may be used to selectively impart motion from a driving member to a driven member. However, an accidental drop in hydraulic-holding pressure may cause the locking pin to instantaneously retract to an unlatched position.

SUMMARY OF THE INVENTION

The invention relates to a hydraulic-pressure actuated locking mechanism operable between a driving and a driven member. More specifically, the invention relates to a mechanism and method of preventing the instantaneous unlatching of the driving and the driven members upon an accidental drop in the hydraulic-holding pressure.

In one aspect of the invention, a hydraulic pressure actuated locking mechanism is provided for operatively connecting a driving member to a driven member including: a housing engageable with one of the members and having an inlet port connectable to a substantially sustained high pressure fluid source for receiving and exhausting entrapped high pressure fluid in the housing; a configured locking pin engageable with the other of the members and high pressure actuatably axially displaceable to an engaged position with respect to the inlet port and the other of the members in response to high pressure fluid entrapped in the housing; wherein the locking pin is spring-biasingly axially displaceable to a substantially disengaged position with respect to the other of the members when the pressure of the entrapped fluid in the housing is low; and wherein the axial displacement and configuration of the locking pin sufficiently overlaps the inlet port to form a variable orifice so that exhausting or bleeding of entrapped fluid from the housing through the inlet port is variable.

In another aspect of the invention, the configurations of the locking pin with respect to the inlet port are over-lapped through increasing size of variable orifice so that outflow increases with increasing port overlap for quick bleed-off. In another aspect of the invention, the configurations of the locking pin with respect to the inlet port are under-lapped through a constricted size of the variable orifice to provide smaller outflow at the beginning of the axial displacement of the locking pin to the disengaged position and increasing outflow with time to accommodate accidental versus intended disengagement of the locking pin with respect to the other of the members.

In another aspect of the invention, a method and apparatus is provided for a hydraulic pressure actuated locking mechanism receiving pressurized fluid from a fluid source, including: a housing including a housing wall defining an inner cavity for receiving a locking pin; the locking pin slidably disposed within the inner cavity, movable between a retracted and an extended position; the locking pin including a cylindrical body having an axial surface and a cylindrical surface; a spring placed within the inner cavity so as to bias the locking pin to the retracted position; a backplate connected to the housing wall so as to form a chamber between the locking pin and the backplate; and wherein the locking pin is axially displaced and held at the extended position by sufficient fluid pressure within the chamber.

In another aspect of the invention, at least one cross-drilled passage and an axial passage is drilled in the cylindrical body of the locking pin to allow the pressurized fluid to flow through the cross-drilled and axial passages.

In another aspect of the invention, a variable orifice is formed at the overlap between a receiving port on the cylindrical surface of the locking pin adjacent to the cross-drilled passage and an inlet port on the inner surface of the housing wall receiving pressurized fluid from the fluid source; and wherein the variable orifice is at a constricted size when the locking pin is at the extended position. In another aspect of the invention, the pressurized fluid flows out from the chamber to the variable orifice through the cross-drilled and the axial passages in response to an accidental drop in the fluid pressure, thereby moving the locking pin towards the retracted position; and wherein the constricted size of the variable orifice dampens the motion of the locking pin into the retracted position.

In another aspect of the invention, a feed orifice is formed on the backplate for transmitting the pressurized fluid from the fluid source to the chamber; a one-way check valve is hydraulically connected to the feed orifice to permit flow of the pressurized fluid into the chamber but prevent exhausting of the pressurized fluid out of the chamber; and a bleed hole is formed on the backplate for exhausting the pressurized fluid from the chamber. In another aspect of the invention, a variable orifice is formed at the overlap between a pin exhaust port on the cylindrical surface of the locking pin adjacent to the cross-drilled passage and a housing exhaust port on the inner surface of the housing wall; wherein the variable orifice is a constricted size at the retracted position; wherein the variable orifice is sealed at the extended position; and further including a seal-length sufficiently formed between the cylindrical surface of the locking pin and the inner surface of the housing wall at the extended position of the locking pin.

In another aspect of the invention, the locking pin is movable between a discrete retracted position and a discrete extended position, further including: a mechanical lock system within the cylindrical body for moving the locking pin between the discrete retracted position and the discrete extended position; and wherein the mechanical lock system is actuated by a pressure pulse formed by the fluid pressure rising to a sufficiently high value from a sufficiently low value.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

The invention relates to a hydraulic pressure actuated locking mechanism, adapted to latch a driving member to a driven member. A mechanism and method is provided of preventing the instantaneous unlatching of the driving and the driven members upon an accidental drop in the hydraulic-holding pressure.

Three embodiments of the invention are described for a cam-and-follower arrangement. However, the locking mechanism is applicable to any mechanism where motion is selectively imparted from a driving to a driven member.

Figure 9:
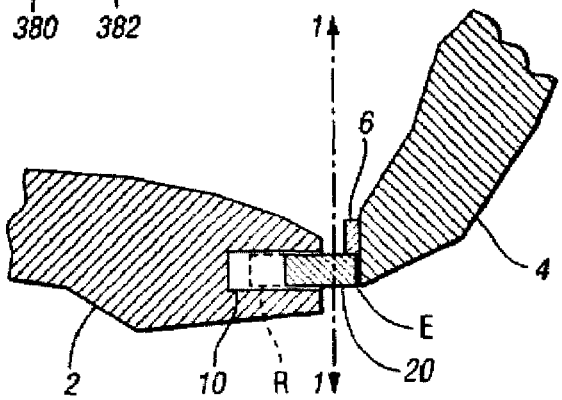
FIG. 9 is a schematic view of a driving member and a driven member and the hydraulic pressure actuated locking mechanism described in the embodiments below.

Referring to FIG. 9, a schematic view of a driving member 2 and a driven member 4 is shown. A hydraulic pressure actuated locking mechanism such as 10 (or 210 or 310 discussed in the embodiments below) may be used to selectively impart motion from the driving member 2 to the driven member 4. The locking mechanism 10 is a part of one member, which can be either the driving member 2, as shown, or the driven member 4. A contact member 6 is part of the remaining or other member. When the locking pin 20 is in an unlatched or retracted position R, shown in dashed lines, the driving member 2 is free to move about without any contact or force imparted to the driven member 4. When the locking pin 20 is in a latched or extended position E, the locking pin 20 makes contact with the contact member 6, resulting in force imparted from the driving member 2 to the driven member 4. In the example shown in FIG. 9, the force is imparted along the axis 1-1. Other suitable configurations for selectively imparting force from a driving to a driven member are also applicable.

First Embodiment

Figure 1:
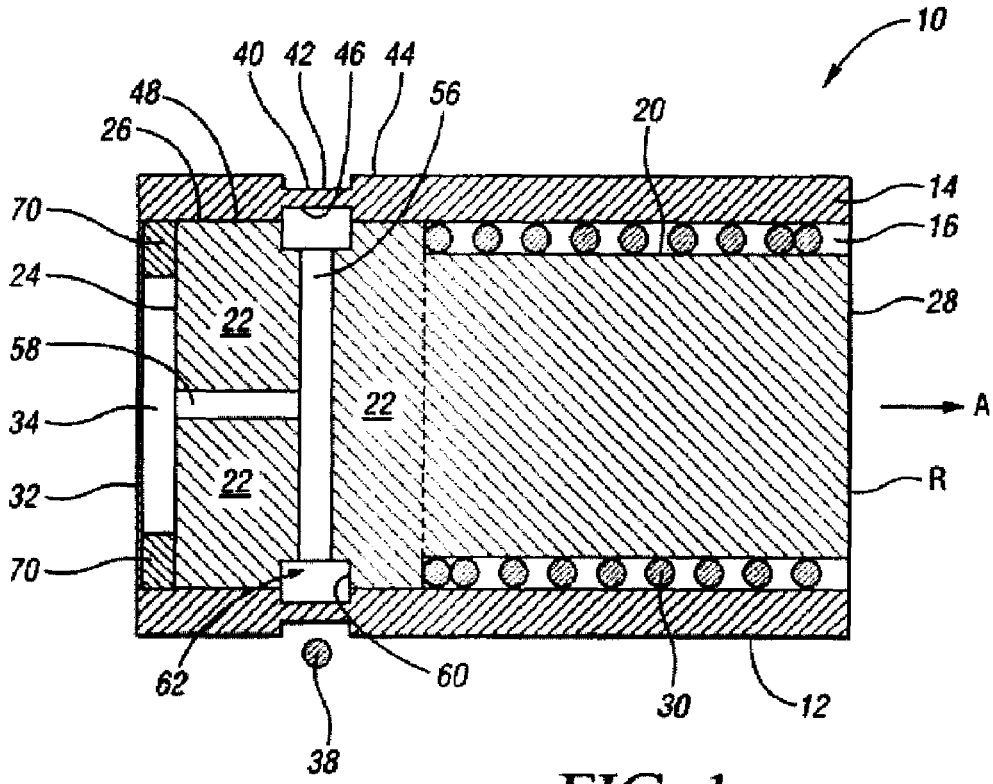
FIG. 1 is a schematic cross sectional view of a hydraulic pressure actuated locking mechanism 10 in a retracted or unlatched position R, in accordance with a first embodiment of the invention.
Figure 2:
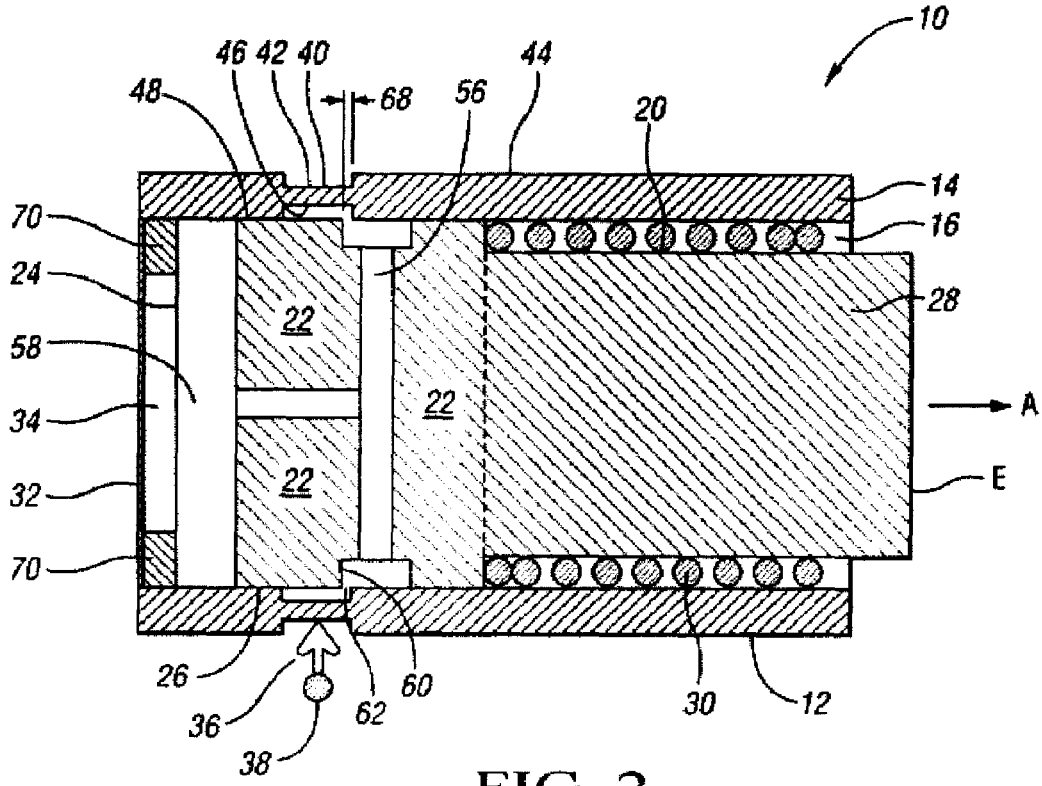
FIG. 2 is a schematic cross sectional view of a hydraulic pressure actuated locking mechanism 10 in an extended or latched position E, in accordance with the first embodiment of the invention.

FIGS. 1 and 2 illustrate a hydraulic pressure actuated locking mechanism 10, in accordance with a first embodiment of the invention. The locking mechanism 10 includes a housing 12. A housing wall 14 defines an inner cavity 16 for receiving a locking pin 20. A locking pin 20 is slidably disposed within the housing 12, movable between an unlatched or retracted position R shown in FIG. 1 and a latched or extended position E shown in FIG. 2.

The locking pin 20 includes a cylindrical body 22 having an axial surface 24 and a cylindrical surface 26. The locking pin 20 may also include a shaft portion 28. A biasing spring 30 is disposed within the inner cavity 16 so as to bias the locking pin 20 to the retracted position R, shown in FIG. 1. A backplate 32 is operably connected to the housing 12 so as to form a chamber 34 between the axial surface 24 of the locking pin 20 and the backplate 32.

The locking mechanism 10 receives pressurized fluid 36 from a fluid source 38. An annular groove 40 is made on a depression 42 on the outer surface 44 of the housing wall 14. An inlet port 46 represents the area of opening on the inner surface 48 of the housing wall 14 and is configured to receive pressurized fluid 36 from a fluid source 38 located adjacent or external to the annular groove 40.

Any suitable method of delivering the pressurized fluid 36 may be used. For instance, the fluid source 38 may be operably connected to a cam finger-follower socket (not shown) located adjacent to the outer surface 44 of the housing wall 14 in hydraulic or fluid communication with the inlet port 46.

A set of passages 56, 58 are drilled within the cylindrical body 22 of the locking pin 20, shown in FIGS. 1 and 2, to enable pressurized fluid 36 to flow from the fluid source 38 via the annular groove 42, inlet port 46 and passages 56, 58 to the chamber 34. For this purpose, a cross-drilled passage 56 is drilled in the cylindrical body of the locking pin, configured to allow the pressurized fluid 36 to flow through the cross-drilled passage 56. An axial passage 58 is drilled in the cylindrical body 22 of the locking pin 20, configured to allow the pressurized fluid 36 to flow through the axial passage 58. The axial passage 58 is connected to the cross-drilled passage 56. The chamber 34 is connected to the axial passage 58. A plurality of cross-drilled passages 56 and axial passages 58 may be made.

A receiving port 60 represents the area of opening on the cylindrical surface 26 of the cross-drilled passage 56 on the cylindrical body 22 of the locking pin 20. A variable orifice 62 is formed by the overlap between the receiving port 60 and the inlet port 46. As mentioned above, the inlet port 46 represents the area of opening on the inner surface 48 of the housing wall 14 adjacent and in hydraulic or fluid communication with the annular groove 40.

The size of the variable orifice 62 changes as the position of the receiving port 60 moves with respect to the inlet port 46. The variable orifice 62 has an expanded size at the retracted position R, shown in FIG. 1. The variable orifice 62 has a constricted size 68 at the extended position E, as discussed below and shown in FIG. 2.

Operation

Pressurized fluid 36 flows from the fluid source 38 through the inlet port 46 to the receiving port 60, shown in FIG. 2. The pressurized fluid 36 then flows through the cross-drilled passage 56 into the axial passage 58 and finally into the chamber 34. The pressurized fluid 36 collects in the chamber 34, thereby pressurizing the chamber 34. With sufficient flow of pressurized fluid 36 into the chamber 34, high fluid pressure within the chamber 34 extends or applies a sufficient force on the axial surface 24 of the locking pin 20 so as to displace the locking pin 20 axially with respect to and through the housing 12 along the direction A into the extended position E, shown in FIG. 2. Thus the locking mechanism 10 is actuated. The biasing spring 30 of the locking pin 20 operating against a fixed portion with respect to the housing 12 determines the minimum hydraulic pressure that is sufficient to displace the locking pin 20 into the extended position E.

As the locking pin 20 slides towards the latched or extended position E, the receiving port 60 moves progressively out of overlap or registry with the inlet port 46, thereby progressively constricting the resultant variable orifice 62. FIG. 2 shows the constricted size 68 of the variable orifice 62 at the extended position E. The locking pin 20 is held at the extended position E through maintaining sufficiently high fluid pressure in the chamber 34.

Accidental Drop in Pressure

If the fluid pressure accidentally drops below a threshold value weaker than the force of the biasing spring 30, the pressurized fluid 36 flows outwards from the chamber 34 through the axial and cross-drilled passage 58, 56 and into or through the variable orifice 62. The flow of pressurized fluid 36 outwards is slowed due to the constricted size 68 of the variable orifice 62 at the extended position E, shown in FIG. 3, thereby damping or slowing the motion of the locking pin 20 into the retracted position R. The accidental drop in the holding pressure may be due to many reasons including, but not limited to, a pressure drop in the hydraulic-communication line from the fluid source 38.

The damping effect on the retraction motion of the locking pin 20 is greatest when the locking pin 20 is initially at the extended position E. This is because the size of the variable orifice 62 gradually increases as the pressurized fluid 36 drains out of the chamber 34 in response to the accidental drop in the fluid pressure and the locking pin 20 moves increasingly towards the retracted position R.

The rate with which the locking pin 20 retracts from the extended position E depends on the rate with which the chamber 34 is emptied. For a given biasing spring 30, the rate is dependent upon the dimensions of the receiving port 60, inlet port 46, axial passage 58 and cross-drilled passage 56 and other factors. If the duration of the dynamic event causing accidental pin retraction is shorter than the duration of locking pin axial travel, the restoration of high pressure in the chamber 34 will re-position the locking pin to its extended position E.

A circumferential stopper 70 is placed in contact with the backplate 32. The stopper 70 physically prevents the locking pin 20 from contacting the backplate 32, while maintaining a hydraulic dead volume in the chamber 34 adjacent to the backplate 32.

The first embodiment retains the ability to unlatch the hydraulically actuated locking mechanism 10 on command. When unlatching is desired, there is a commanded decrease in hydraulic pressure of the fluid source 38. Pressurized fluid 36 within the chamber 34 will then flow outwards through the cross-drilled and axial passage 56, 58 into and through the variable orifice 62, resulting in a decrease in the hydraulic pressure acting on the locking pin 20 and a subsequent retraction of the locking pin 20 due to the bias of spring 30.

Thus, the first embodiment provides damping to the retraction motion of the locking pin 20, due to an accidental drop in pressure that may otherwise cause instantaneous unlatching of the locking mechanism 10.

In summary, a hydraulic pressure actuated locking mechanism 10 is provided for operatively connecting a driving member 2 to a driven member 4 including: a housing 12 engageable with one of the members 2, 4 and having an inlet port 46 connectable to a substantially sustained high pressure fluid source 38 for receiving and exhausting entrapped high pressure fluid 36 in the housing 12; a configured locking pin 20 engageable with the other of the members 4, 2 and high pressure actuatably axially displaceable to an engaged position with respect to the inlet port 46 and the other of the members 4, 2 in response to high pressure fluid 36 entrapped in the housing 12; wherein the locking pin 20 is spring-biasingly axially displaceable to a substantially disengaged position with respect to the other of the members 4, 2 when the pressure of the entrapped fluid 36 in the housing 12 is low; and wherein the axial displacement and configuration of the locking pin 20 sufficiently overlaps the inlet port 46 to form a variable orifice 62 so that exhausting or bleeding of entrapped fluid 36 from the housing 12 through the inlet port 46 is variable.

Further, the configurations of the locking pin 20 with respect to the inlet port 46 may be over-lapped so that outflow increases with increasing port overlap through increasing size of variable orifice 62 for quick bleed-off. The configurations of the locking pin 20 with respect to the inlet port 46 may be under-lapped through a constricted size 68 of the variable orifice 62 to provide smaller outflow at the beginning of the axial displacement of the locking pin to the disengaged position and increasing outflow with time to accommodate accidental versus intended disengagement of the locking pin with respect to the other of the members 4, 2.

Second Embodiment

Figure 3:
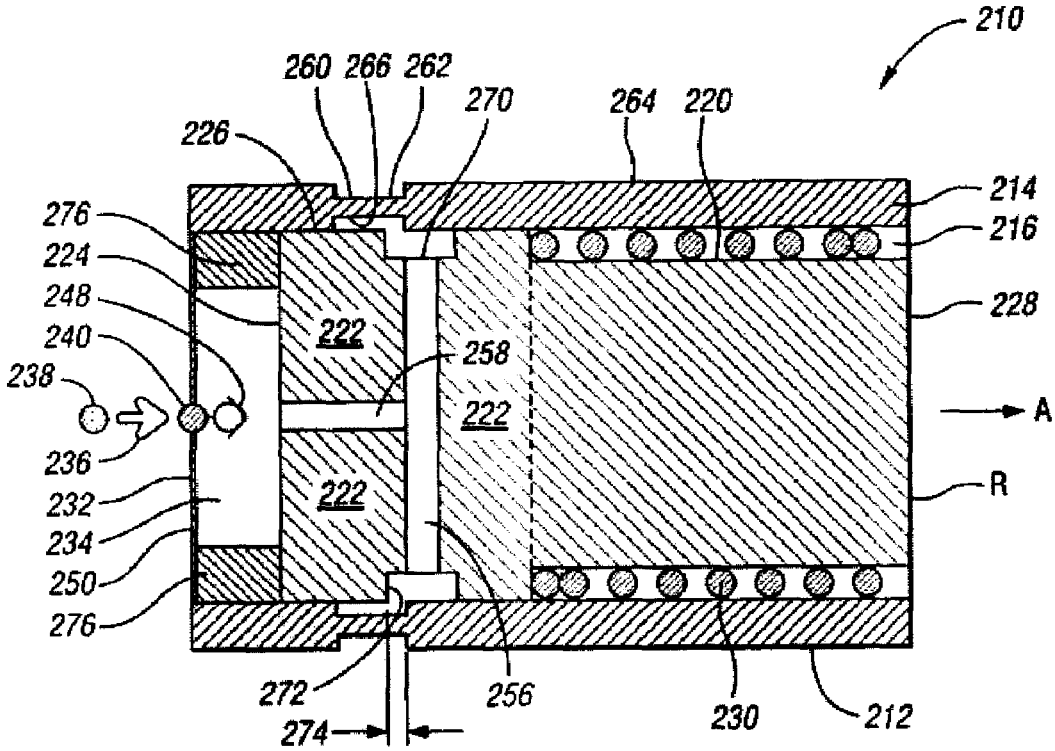
FIG. 3 is a schematic cross sectional view of a hydraulic pressure actuated locking mechanism 210 in a retracted or unlatched position R, in accordance with a second embodiment of the invention.
Figure 4:
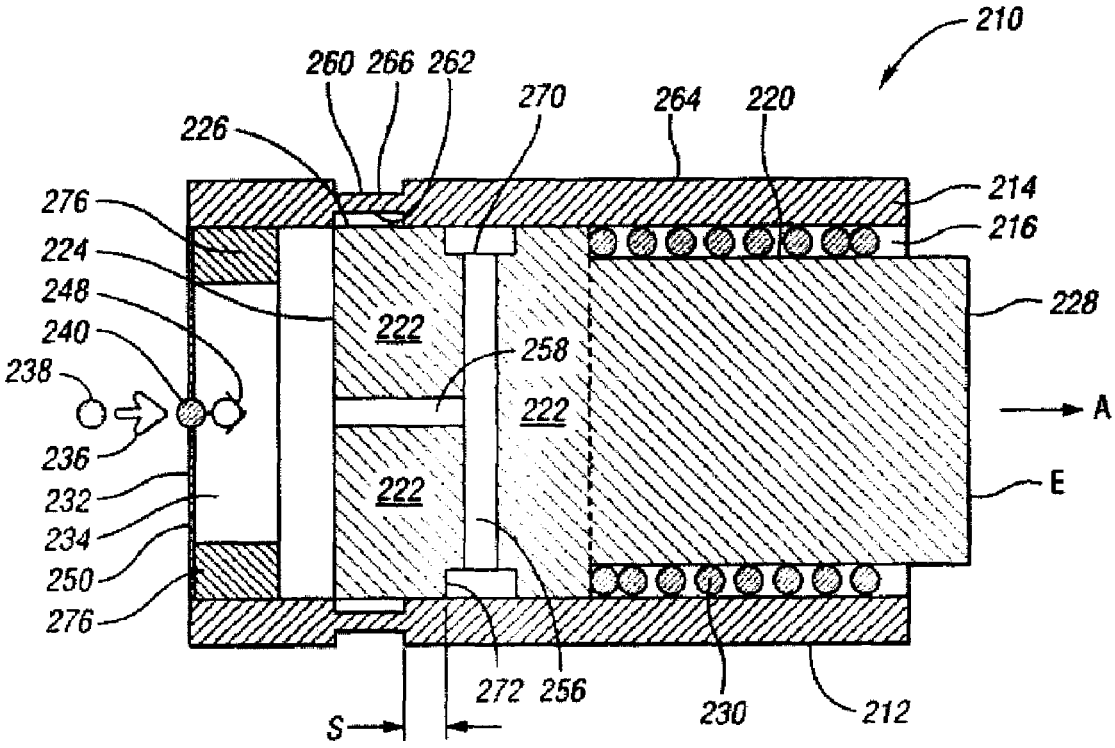
FIG. 4 is a schematic cross sectional view of a hydraulic pressure actuated locking mechanism 210 in an extended or latched position E, in accordance with the second embodiment of the invention.

FIGS. 3 and 4 illustrate a hydraulic pressure actuated locking mechanism 210, in accordance with a second embodiment of the invention. The locking mechanism 210 includes a housing 212, with a housing wall 214 defining an inner cavity 216. A locking pin 220 is slidably disposed within the housing 212. The locking pin 220 includes a cylindrical body 222, an axial surface 224 and a cylindrical surface 226. The locking pin 220 may include a shaft portion 228.

The locking pin 220 is movable between an unlatched or retracted position R shown in FIG. 3 and a latched or extended position E shown in FIG. 4. A biasing spring 230 is disposed within the inner cavity 216 so as to bias the locking pin 220 to the retracted position R. A backplate 232 is operably connected to the housing 212 so as to form a chamber 234 between the axial surface 224 of the locking pin 220 and the backplate 232. The locking mechanism 210 receives pressurized fluid 236 through a fluid source 238.

A feed orifice 240 operably connected to the chamber 234 is configured to receive pressurized fluid 236 from a fluid source 238, shown in FIGS. 3 and 4. The feed orifice 240 may be made on the backplate 232 and connects to the fluid source 238. Any suitable method of delivering the pressurized fluid 236 may be used, as described for the first embodiment.

A one-way check valve 248 hydraulically communicating with the feed orifice 240 is employed. The one-way check valve 248 permits flow of pressurized fluid 236 into the chamber 234 but prevents exhaustion of the pressurized fluid 236 out of the chamber 234. A bleed hole 250 operably connected to the chamber 234 is constructed and configured to hydraulically or fluidly communicate the chamber 234 to the ambient. The bleed hole 250 functions as an exhaust route for exhausting or draining pressurized fluid 236 from the chamber 234, regardless of the position of the locking pin 220. The bleed hole 250 may be constructed on the backplate 232.

A set of passages are drilled within the cylindrical body 222 of the locking pin 220, to enable pressurized fluid 236 to exhaust from the chamber 234 to the ambient, shown in FIGS. 3 and 4. A cross-drilled passage 256 is drilled in the locking pin, configured to allow the pressurized fluid 36 to flow through the cross-drilled passage. An axial passage 258 is drilled in the locking pin, configured to allow the pressurized fluid 236 to flow through the axial passage 258. The axial passage 258 is connected to the cross-drilled passage 256. The chamber 234 is connected to the axial passage 258 in the locking pin 220. A plurality of cross-drilled passages 256 may be made.

An annular groove 260 is made on a depression 262 on the outer surface 264 of the housing wall 214, shown in FIGS. 3 and 4. A housing exhaust port 266 represents the area of opening on the inner surface 268 of the housing wall 214 and is in fluid communication with the annular groove 260. The housing exhaust port 266 communicates the chamber 234 to the ambient and is configured to allow the pressurized fluid 236 to exhaust outwards.

A pin exhaust port 270 represents the area of opening on the cylindrical surface of the cross-drilled passage 256 on the cylindrical body 222 of the locking pin 220. The pin exhaust port overlaps with the housing exhaust port 266 on the housing wall 214 so as to form a variable orifice 272. The size of the variable orifice 272 changes as the position of the pin exhaust port 270 moves with respect to the housing exhaust port 266.

The variable orifice 272 functions as an exhaust route for the pressurized fluid 236. Pressurized fluid 236 may flow from the chamber 234 into the variable orifice 272 through the cross-drilled and axial passages 256, 258. Unlike the first embodiment, the variable orifice 272 has a constricted size 274 at the retracted position R due to the overlap between the pin exhaust port 270 and housing exhaust port 266, shown in FIG. 3. The variable orifice 272 is sealed at the latched or extended position E, as shown in FIG. 4 and discussed below.

A circumferential stopper 276 is in placed in contact with the backplate 232. The stopper 276 physically prevents the locking pin 220 from contacting the backplate 232, while maintaining a hydraulic dead volume at the back of the chamber 234 adjacent to the backplate 232.

Operation

Pressurized fluid 236 from the fluid source 238 enters the chamber 234 through the feed orifice 240, shown in FIG. 3. The pressurized fluid 236 collects in the chamber 234, thereby pressurizing the chamber 234. With sufficient flow of pressurized fluid 236 into the chamber 234, high fluid pressure within the chamber 234 extends or applies a sufficient force on the axial surface 224 of the locking pin 220 so as to displace the locking pin 220 axially along the direction A into the extended position E, shown in FIG. 4. As the locking pin 220 moves towards the extended position, the size of the variable orifice 272 gradually decreases to zero. At approximately mid-travel of the locking pin 220, the variable orifice 272 becomes sealed and the pressure build up at the chamber 234 accelerates.

In the latched or extended position E of the locking pin, a seal-length S is formed by the cylindrical surface 226 of the locking pin 220, between the pin exhaust port 270 and the housing exhaust port 266, as shown in FIG. 4.

Accidental Drop in Pressure

The locking pin 220 is held at the extended position E through maintaining sufficiently high fluid pressure in the chamber 234. If the fluid pressure accidentally drops below a threshold value weaker than the force of the biasing spring 230, the pressurized fluid 236 flows out of the chamber 234 through the bleed hole 250, causing the locking pin 220 to retract. In the extended position E, the only available exhaust route from the chamber 234 is the bleed hole 250 as the variable orifice 272 is sealed at this position, as described above. Thus the retraction motion of the locking pin 220 is damped. The dampening effect and the rate with which the locking pin initially retracts is controlled by the sizing of the bleed hole 250, until the variable orifice 272 is re-opened.

The damping effect on the retraction motion of the locking pin 220 is greatest when the locking pin 220 is initially at the extended position E and the seal length S is at a maximum. As the locking pin 220 is displaced sufficiently towards the retracted position R, the pin exhaust port 270 and housing exhaust port 266 re-overlap such that the seal length S gradually becomes zero and the variable orifice 272 is re-opened. As the size of the variable orifice 272 increases, the retraction motion accelerates.

The accidental drop in the holding pressure may be due to many reasons including, but not limited to, a pressure drop in the hydraulic-communication line from the fluid source 238.

In summary, the second embodiment provides damping to the retraction motion of the locking pin 220, due to an accidental drop in pressure that may otherwise cause unlatching of the mechanism by an instantaneous retraction of the locking pin. The time delay margin against accidental unlatching of the mechanism 210 depends on multiple factors, such as the following: the force of the biasing spring 230, the dimensions of the axial surface 224 of the locking pin 220, the size of the small bleed hole 250, and the seal length S.

The second embodiment retains the ability to unlatch the hydraulically actuated locking mechanism 210 on command. When unlatching is desired, there is a commanded decrease in hydraulic pressure of the fluid source 238. Pressurized fluid 236 within the chamber 234 flows outwards through the bleed hole 250, resulting in a decrease in the hydraulic pressure acting on the locking pin 220 and a subsequent retraction of the locking pin 220. As the size of the variable orifice 272 increases, the retraction motion accelerates.

Third Embodiment

The third embodiment for the invention is illustrated in FIGS. 5, 6, 7 and 8. In the third embodiment, the locking pin 320 has two discrete states; either an unlatched or retracted position R; or a latched or extended position E. For the locking pin 320 to change from an unlatched-to-latched state or latched-to-unlatched state, a pressure pulse P is required. The pressure pulse P is defined as hydraulic pressure of the pressurized fluid 336 in the chamber 334 rising to a sufficiently high value from a sufficiently low value. Steady pressures at either low or high values will not cause a change of state.

Figure 5:
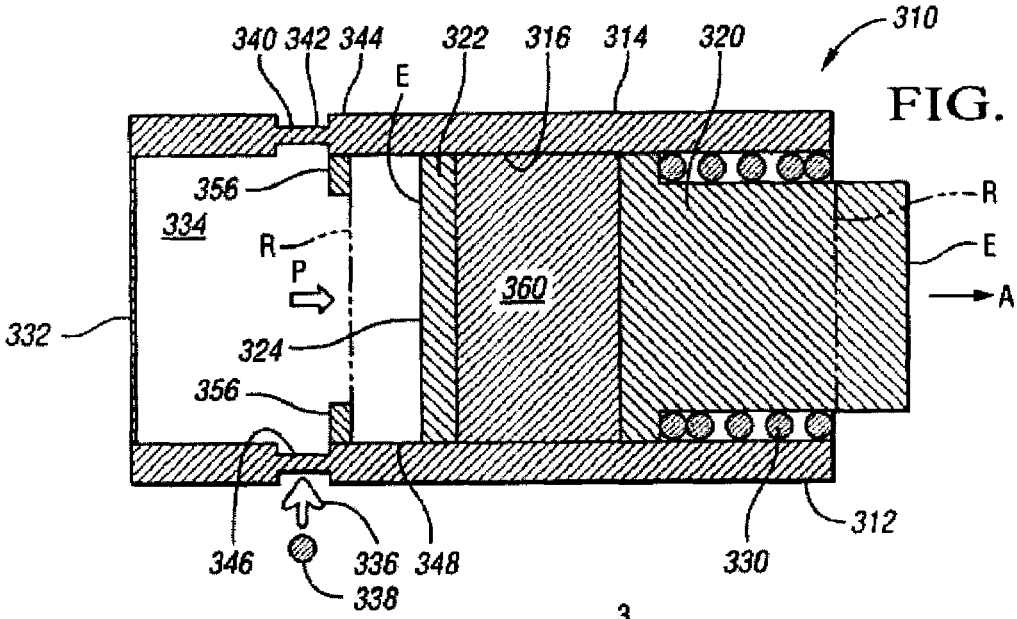
FIG. 5 is a schematic cross sectional view illustrating a hydraulic pressure actuated locking mechanism 310 in an extended or latched position E, with the retracted or unlatched position R shown in dashed lines, in accordance with a third embodiment of the invention.

A method of preventing instantaneous retraction of a locking pin upon an accidental drop in hydraulic pressure is provided in this embodiment as in the previous embodiments. FIG. 5 is a schematic view illustrating the hydraulic pressure actuated locking mechanism 310 in an extended or latched position E, with the retracted or unlatched position R shown in dashed lines. The locking mechanism 310 includes a housing 312, with a housing wall 314 defining an inner cavity 316. A locking pin 320 is slidably disposed within the inner cavity 316.

A biasing spring 330 is disposed within the inner cavity 316 so as to bias the locking pin 320 to a retracted position R. A backplate 332 is operably connected to the housing 312 so as to form a chamber 334 between the axial surface 324 of the locking pin 320 and the backplate 332, shown in FIG. 5. The locking mechanism 310 receives pressurized fluid 336 through a fluid source 338, An annular feed groove 340 is made on a depression 342 on the outer surface 344 of the housing wall 314, shown in FIG. 5. An inlet port 346 represents the area of opening on the inner surface 348 of the housing wall 314 and is configured to receive pressurized fluid 336 from a fluid source 338 located adjacent or external to the annular groove 340. The inlet port 346 is in fluid communication with the chamber 334. Any suitable method of delivering pressurized fluid 336 may be used.

A circumferential stopper 356 prevents the locking pin 320 from contacting the backplate 332, while maintaining a hydraulic dead volume adjacent to the backplate 332.

Figure 6:
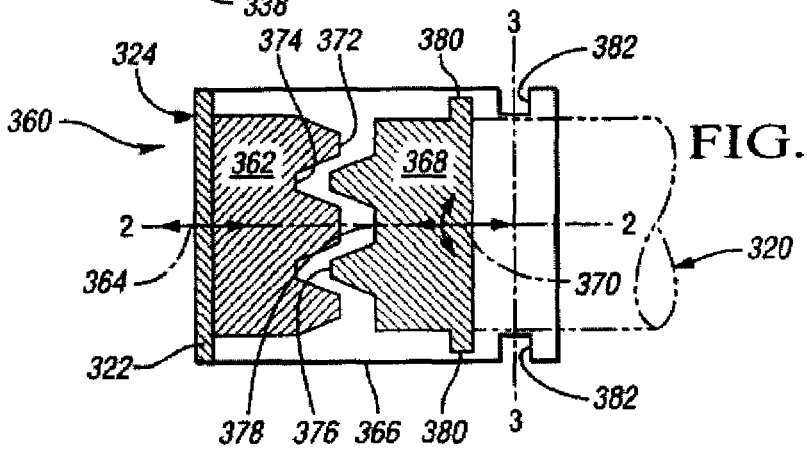
FIG. 6 is a schematic cross sectional view of a mechanical lock system 360 illustrating a first cam member 362 and a second cam member 368, in accordance with the third embodiment of the invention.

The pressure pulse P activates a mechanical lock system such as 360 (shown in FIG. 6) in the locking pin 320 to change the state of the locking pin 320. The duration of the pressure pulse at the high pressure level does not affect the latching function of the mechanical lock system 360. FIG. 6 is a schematic cross-sectional view of the mechanical lock system 360. The mechanical lock system 360 includes a first cam member 362 having a cylindrical piston portion 322, constrained for axial motion 364 along the axis 2-2 within a lock cover 366. The mechanical lock system 360 includes a second cam member 368, constrained for axial-rotational motion 370 along or about the axis 2-2 within the lock cover 366.

The first cam member 362 has at least one first prong 372 and first indent 374 engageable with at least a second prong 376 and second indent 378 on the second cam member 368, for transferring the axial motion 364 or input of the first cam member 362 into axial-rotational motion 370 or output of the second cam member 368, shown in FIG. 6. The number of prongs and indents for both the first and second cam members 362, 368 may be varied.

Figure 7:
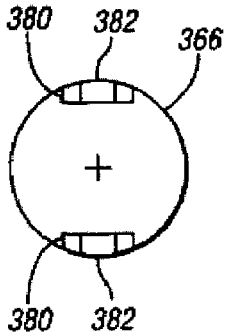
FIG. 7 is a schematic cross-sectional view of the mechanical lock system 360 along the axis 3-3 (shown in FIG. 6) showing the latching shoulder 382 on the lock cover 366 engaged with the latching projection 380 on the second cam member 368, in accordance with the third embodiment of the invention.
Figure 8:
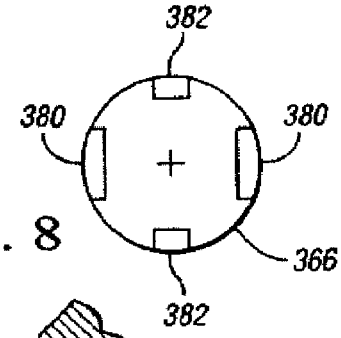
FIG. 8 is a schematic cross-sectional view of the mechanical lock system 360 along the axis 3-3 (shown in FIG. 6) showing the latching shoulder 382 on the lock cover 366 disengaged from the latching projection 380 on the second cam member 368, in accordance with the third embodiment of the invention.

The second cam member 368 further includes at least one latching projection 380 selectively engageable with at least one latching shoulder 382 on the lock cover 366 to produce a change of state for the locking pin 320 from unlatched-to-latched or latched-to-unlatched condition. FIG. 7 is a cross-sectional view of the mechanical lock system 360 along the axis 3-3 (shown in FIG. 6) showing the latching shoulder 382 on the lock cover 366 engaged with the latching projection 380 on the second cam member 368. FIG. 8 is a cross-sectional view of the mechanical lock system 360 along the axis 3-3 (shown in FIG. 6) showing the latching shoulder 382 on the lock cover 366 disengaged from the latching projection 380 on the second cam member 368.

Operation

When the hydraulic pressure of the pressurized fluid 336 in the chamber 334 rises to a sufficiently high value from a sufficiently low value, a pressure pulse P is produced exerting a force on the axial surface 324 of the cylindrical piston portion 322 of first cam member 362. The force results in axial motion 364 of the first cam member 362 along the axis 2-2 and subsequent axial-rotational motion by the second cam member 368. The rotational motion engages the latching projection 380 on the second cam member 368 with the latching shoulder 382 on the lock cover 366 to produce a change of state for the locking pin 320 from an unlatched-to-latched condition. A subsequent pressure pulse disengages the latching projection 380 from the latching shoulder 382.

In summary, an accidental drop in fluid pressure will not cause instantaneous retraction of the locking pin 320, as latching is a discrete state of contact between the latching projection 380 and the latching shoulder 382.

While the best modes for carrying out the invention have been described in detail, those familiar with the art to which this invention relates will recognize various alternative designs and embodiments for practicing the invention within the scope of the appended claims.

The invention claimed is:

1. A hydraulic pressure actuated locking mechanism receiving pressurized fluid from a fluid source, comprising:

a housing including a housing wall defining an inner cavity for receiving a locking pin;

said locking pin being slidably disposed within said inner cavity, movable between a discrete retracted and a discrete extended position; said locking pin including a cylindrical body having an axial surface and a cylindrical surface;

a mechanical lock system within the locking pin for moving said locking pin between said discrete retracted position and said discrete extended position;

wherein said mechanical lock system includes a first cam member constrained for axial motion within said mechanical lock system;

wherein said mechanical lock system includes a second cam member constrained for axial-rotational motion within said mechanical lock system;

a spring placed within said inner cavity so as to bias said locking pin to said discrete retracted position;

a backplate connected to said housing wall so as to form a chamber between said locking pin and said backplate; and wherein said locking pin is axially displaced and held at said discrete extended position by sufficient fluid pressure within said chamber.

2. The mechanism of claim 1, wherein said mechanical lock system is actuated by a pressure pulse formed by said fluid pressure rising to a sufficiently high value from a sufficiently low value.

3. The mechanism of claim 2, further comprising:

an inlet port formed on the inner surface of said housing wall for receiving said pressurized fluid from said fluid source;

a circumferential stopper on the inner surface of said housing wall, such that said inlet port is connected to said chamber; and wherein said pressurized fluid flows to said chamber from said fluid source through said inlet port to form said pressure pulse.

4. The mechanism of claim 2:

wherein said mechanical lock system within said cylindrical body includes a lock cover;

said first cam member being constrained for axial motion within said lock cover;

said second cam member being constrained for axial-rotational motion within said lock cover; and including at least two latching shoulders on said lock cover that are selectively engageable with at least two respective latching projections on said second cam member.

5. The mechanism of claim 4:

wherein said pressure pulse extends a force on said first cam member to produce said axial motion of said first cam member;

wherein at least one indent on said first cam member selectively engages with a corresponding prong on said second cam member to convert said axial motion of said first cam member into axial-rotational motion by said second cam member;

wherein said at least two latching shoulders on said lock cover selectively engages with said at least two respective latching projections on said second cam member to discretely move said locking pin between said discrete retracted position and said discrete extended position, as a result of said axial-rotational motion of said second cam member;

wherein the contact between the latching shoulders and the respective latching projections maintain the latched position even when the fluid pressure is low; and wherein application of a subsequent pressure pulse axially displaces the first cam member, and axially displaces and rotates the second cam member, to disengage the latching projections from the respective latching shoulders, for a commanded retraction of the locking pin.

6. A method of locking comprising:

forming a housing including a housing wall defining an inner cavity for receiving a locking pin;

disposing a locking pin slidably within said inner cavity, said locking pin being movable between a retracted position and an extended position through a mechanical lock system within the locking pin;

placing a spring within said inner cavity so as to bias said locking pin to said retracted position;

connecting a backplate to said housing wall so as to form a chamber between said locking pin and said backplate;

receiving pressurized fluid in said chamber from a fluid source, wherein a pressure pulse is formed by said fluid pressure in said chamber rising to a sufficiently high value from a sufficiently low value;

applying said pressure pulse to axially displace a first cam member within said mechanical lock system in order to axially displace and rotate a second cam member; and selectively engaging at least one indent on said first cam member with a corresponding prong on a second cam member within said mechanical lock system, thereby converting said axial motion of said first cam member into said axial-rotational motion of said second cam member.

7. The method of claim 6, further comprising:

selectively engaging at least two latching shoulders in said mechanical lock system with at least two respective latching projections on said second cam member through the axial-rotational motion of said second cam member, thereby moving said locking pin to said extended position;

the first cam member being constrained for said axial motion within said mechanical lock system; and the second cam member being constrained for said axial-rotational within said mechanical lock system.

8. The method of claim 7, further comprising:

applying a subsequent pressure pulse to axially displace the first cam member, in order to axially displace and rotate the second cam member;

wherein said axial-rotational motion of said second cam member disengages said latching projections from the respective latching shoulders, for a commanded retraction of the locking pin; and wherein the contact between the latching shoulders and the respective latching projections maintain the latched position even when the fluid pressure is low.

9. A hydraulic pressure actuated locking mechanism receiving pressurized fluid from a fluid source, comprising:

a housing including a housing wall defining an inner cavity for receiving a locking pin;

said locking pin being slidably disposed within said inner cavity;

a spring placed within said inner cavity so as to bias said locking pin to a retracted position;

a backplate connected to said housing wall so as to form a chamber between said locking pin and said backplate;

wherein said locking pin is axially displaced and held at an extended position by sufficient fluid pressure within said chamber;

a mechanical lock system within the locking pin for moving said locking pin between said retracted position and said extended position, the mechanical lock system including a lock cover;

wherein said mechanical lock system includes a first cam member constrained for axial motion within said lock cover; and wherein said mechanical lock system includes a second cam member constrained for axial-rotational motion within said lock cover.

10. The mechanism of claim 9:

wherein said mechanical lock system is actuated by a pressure pulse formed by said fluid pressure rising to a sufficiently high value from a sufficiently low value, said pressure pulse extending a force on said first cam member to produce an axial motion of said first cam member;

wherein at least one indent on said first cam member selectively engages with a corresponding prong on said second cam member to convert said axial motion of said first cam member into said axial-rotational motion by said second cam member.

11. The mechanism of claim 10, further comprising:

at least two latching shoulders on said lock cover, said latching shoulders being selectively engageable with at least two respective latching projections on said second cam member; and wherein said axial-rotational motion of said second cam member induces said at least two latching shoulders on said lock cover to selectively engage with said at least two respective latching projections on said second cam member to move said locking pin to said extended position.

* * * * *